United States Patent [19]

Bönigk et al.

[11] Patent Number: 4,990,793

[45] Date of Patent: Feb. 5, 1991

[54] MEASUREMENT OF DEGREE OF INTERMINGLING AND MEASURING APPARATUS THEREFOR

[75] Inventors: Burkhard Bönigk, Königsbrunn; Ingolf Jacob, Untermeitingen, both of Fed. Rep. of Germany

[73] Assignee: Hoechst Aktiengesellschaft, Fed. Rep. of Germany

[21] Appl. No.: 342,289

[22] Filed: Apr. 24, 1989

[30] Foreign Application Priority Data

Apr. 30, 1988 [DE] Fed. Rep. of Germany ..... 3814745
Aug. 17, 1988 [DE] Fed. Rep. of Germany ..... 3827866

[51] Int. Cl.[5] ..... G01N 21/86
[52] U.S. Cl. ..... 250/571; 356/238
[58] Field of Search ..... 250/559, 571, 572; 356/238, 429; 73/37.7, 159, 160

[56] References Cited

U.S. PATENT DOCUMENTS 2,824,488 8/1954 Bridges et al. ..... 250/571
4,057,350 11/1977 Craig ..... 356/429
4,213,056 7/1980 Matsumura et al. ..... 250/559

*Primary Examiner*—David C. Nelms
*Attorney, Agent, or Firm*—Connolly and Hutz

[57] ABSTRACT

Method for measuring the degree of intermingling of yarns where an optical sensor is used to register intermingled and non-intermingled yarn sections, which comprises performing the measurement on a yarn which has been laid with no or low tension onto a moving support which transports the yarn past the optical sensor at a selectable, constant speed at a distance suitable for registering the yarn properties, and an apparatus for carrying out this method.

16 Claims, 6 Drawing Sheets

VIa
VIb
A
B
1
6
7
11
12
13
14
15
16
17
18
19

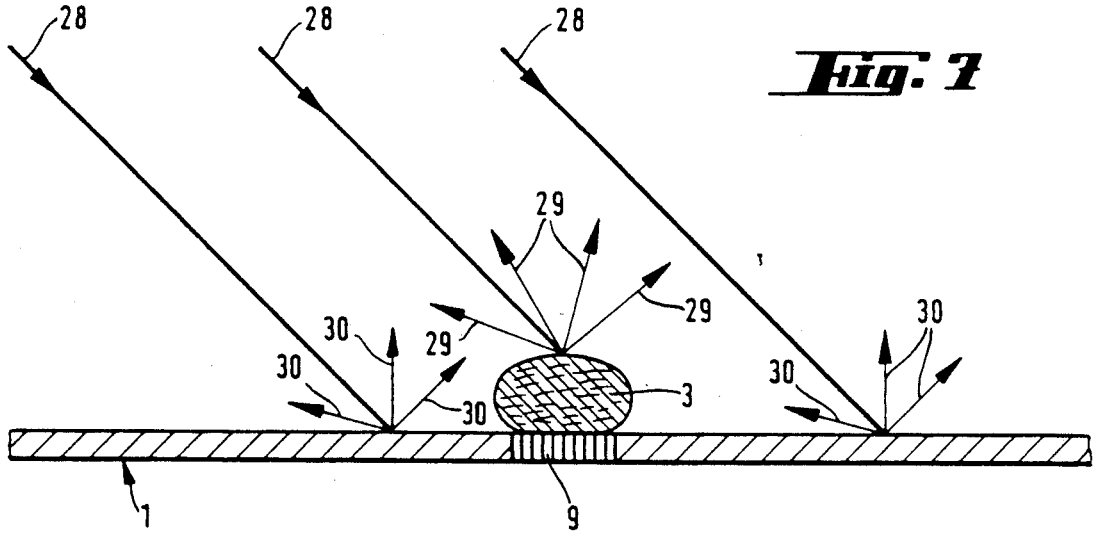
Fig. 7
Fig. 8
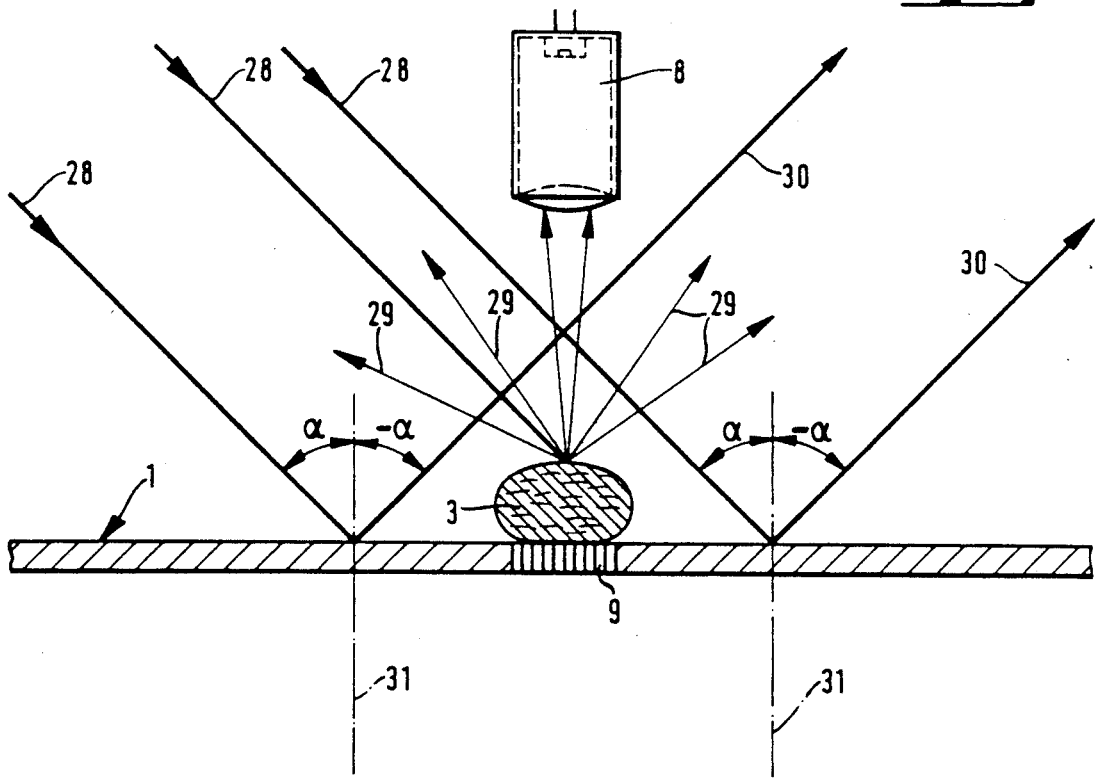

MEASUREMENT OF DEGREE OF INTERMINGLING AND MEASURING APPARATUS THEREFOR

BACKGROUND OF THE INVENTION

The present invention relates to a method for the continuous measurement of the degree of intermingling of yarns and to a suitable measuring apparatus therefor.

Their cohesion is of decisive importance for the further processing of yarns. In the production of yarns, yarn cohesion is obtained for example by twisting, or by intermingling the individual filaments in jet nozzles. Intermingling is a particularly economical measure. However, it does not produce completely uniform yarn cohesion over the entire length of the yarn, but leads to the formation of individual more or less regularly spaced-apart intermingled places where the filaments are closely bonded together, and looser, bulkier areas in between of low yarn cohesion. This structure on the one hand confers a particular textile overall appearance on the yarns, but on the other also affects their further processibility.

The prerequisite for any non-damaging and problem-free further processing of intermingled yarns is that the intermingled areas are sufficiently close together. Missing intermingled areas have an adverse, in certain circumstances even catastrophic, effect on fabric quality and loom. It is therefore of particular importance to monitor the uniformity of the intermingling continuously.

One problem with the monitoring of yarn intermingling and the detection of non-intermingled areas (yarn bulges) is that any tension applied to the yarn serves to thin out and hence to disguise the non-intermingled areas, which makes their detection very difficult.

At present, four methods are used in industry for detecting non-intermingled areas in weaving counts:

(1) Visual examination by an experienced yarn examiner ("water test") In this test method, described in DE Offenlegungsschrift No. 2,901,165, yarn sections are introduced without tension into a water-filled vessel having a dark floor and the intermingled areas are then detected visually. Even if this visual assessment were replaced by an automatic optical apparatus, this water test would remain unsuitable for continuous measurement.

(2) Further merely batchwise test methods are the needle test and the falling hook test, based on the same principle described in U.S. Pat. No. 2,985,995.

(3) A continuous electrostatic test method is described in "Chemiefasern/Textilindustrie" (1978) page 788 et seq. In this method, the yarn is subjected to the impingement of a high electric charge and then guided through a grounded tube, and the filament spreads out considerably in the non-intermingled areas. The consequently more prominent yarn bulges can then be counted with a light barrier along which the yarn is passed. This method requires a relatively complicated measuring means and again only works satisfactorily if the yarn tension is not too high.

(4) In mechanical sensing methods, which hitherto have permitted the highest yarn speed, the intermingled yarn is pulled through a gap between a stationary abutment and a force- or distance-recording sensing head supported by and liftable off the abutment. An instrument of this class is described for example in "Chemiefasern/Textilindustrie" volume 36 (1986), page 99 to 103. These instruments utilize the fact that the intermingled yarn sections cannot be pressed as flat as the non-intermingled yarn sections. The intermingled areas therefore exert a greater force on the sensing head than the non-intermingled areas.

An unsatisfactory feature with all four methods is the very low test speed. The yarn cannot be analyzed at a transport speed of more than 10 meters per minute (in the case of mechanical sensing). The production speed, however, is in general several hundred meters per minute. For this reason, the measurement of the degree of intermingling is at present possible only batchwise.

SUMMARY OF THE INVENTION

The present invention overcomes this prior art defect by providing a method for measuring the degree of intermingling of yarns where an optical sensor registers intermingled and non-intermingled yarn sections, which is distinctive because the measurement is carried out on a yarn which has been deposited with low or no tension. The relative motion between the optical sensor and the yarn required for registering intermingled and non-intermingled yarn sections is advantageously obtained by effecting the low-tension or tension-free deposition onto a moving yarn transport support which transports the yarn at a selectable, constant speed past the sensor at a distance suitable for registering the yarn properties. To fix the yarn on the surface without subjecting it to any tension, use is made of an at least partly gas permeable yarn transport surface through which a gas stream is passed from the yarn deposition side. To avoid loop formation in the yarn to be measured, the measurement is advantageously carried out at the delivery speed predetermined by the yarn delivery system. This measuring speed can be within the range from 10 to 800 meters per minute.

BRIEF DESCRIPTION OF THE DRAWING

In the embodiments below, reference is made to FIGS. 1 to 6, which will now be briefly explained.

FIGS. 7, 8 and 9 illustrate the light reflection at the yarn (3) and at the yarn transport support (1) with the rays (28) symbolizing the incident light, the rays (29) the light reflected by the yarn and the rays (30) the light reflected by the transport support.

DETAILED DESCRIPTION OF THE INVENTION

Figure 1:
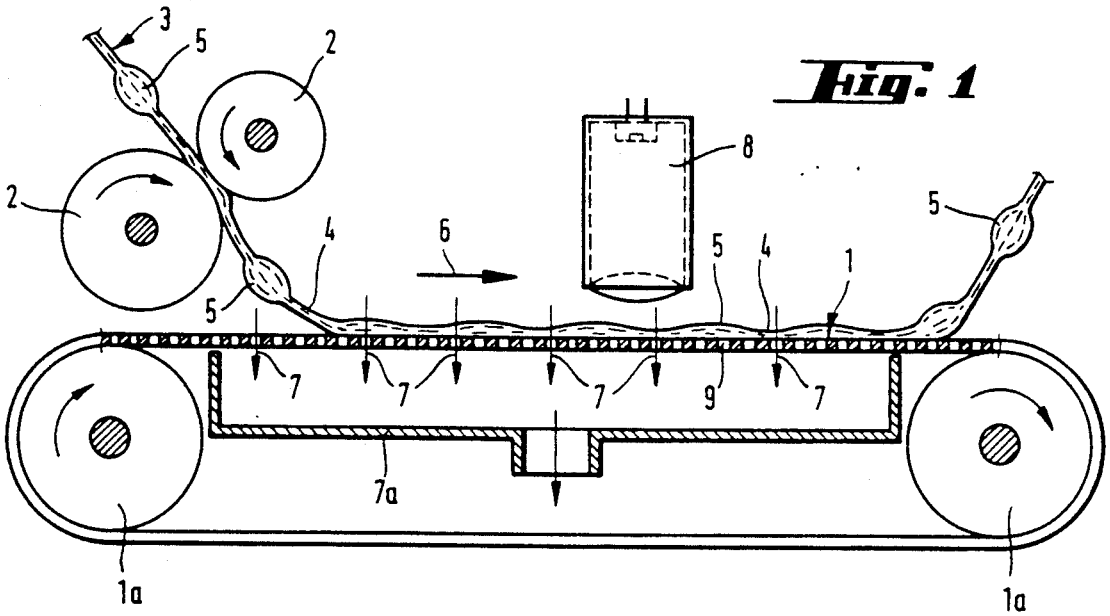
FIG. 1 is a schematic representation of the principle of the measuring method according to the invention, showing the yarn deposition surface (1) moving in the direction of arrow (6), the yarn delivery system (2), the yarn (3) with intermingled (4) and non-intermingled (5) yarn sections, and the optical sensor (8) for analyzing the yarn structure. The arrows (7) indicate the direction of the gas stream flowing through the surface (1).
Figure 2:
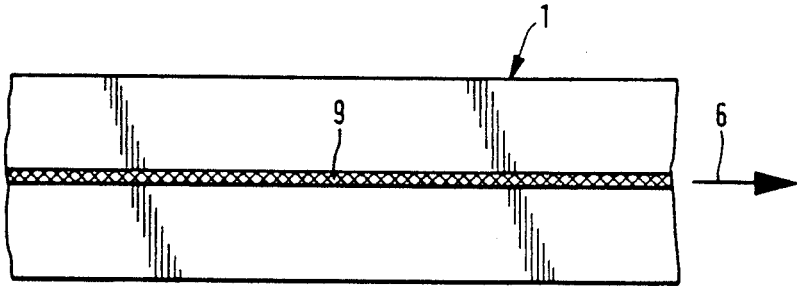
FIG. 2 is a plan view of a support (1) which has a narrow gas permeable zone (9) extending in the transport direction of the support.
Figure 3:
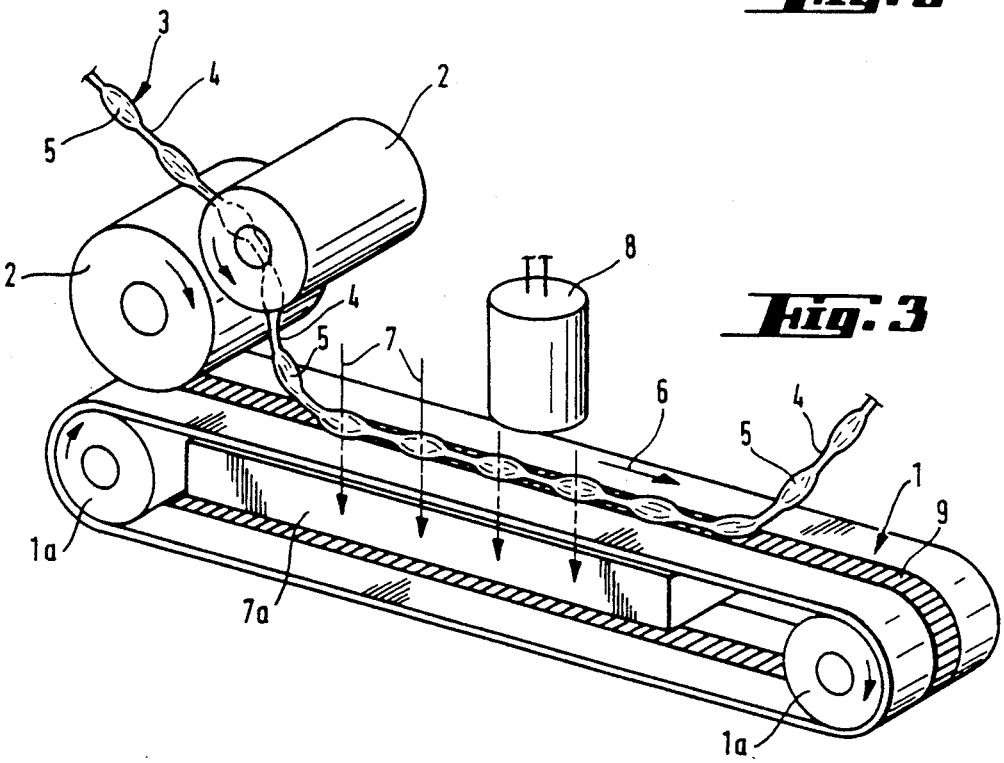
FIG. 3 is a perspective view showing a yarn support (1) moving in the direction of the arrow (6) and having a narrow gas permeable zone (9) extending in the transport direction, an intermingled yarn (3) delivered by the delivery system (2) and deposited tensionlessly on the support and having intermingled (4) and non-intermingled (5) yarn sections, and the photosensor (8) mounted above the yarn transport system. The arrows (7) indicate the direction of a gas stream flowing through the yarn and surface.

As FIGS. 1 and 3 show, the yarn intermingled (3) is delivered by a delivery system (2) and deposited without tension onto a support (1) which is moving in the arrow direction (6) and which can be guided endlessly around deflection rolls (1*a*). A gas stream which is produced for example by a suction box (7*a*) and which penetrates the yarn and surface in the direction of the arrows (7) from the yarn side ensures that the yarn is pressed against the support without any tension being necessary in the yarn. The said airstream also has the effect that the non-intermingled yarn sections become spread out flat on the support and as a result are particularly readily distinguishable from the narrow intermingled yarn sections. The photosensor (8) therefore can satisfactorily identify intermingled and non-intermingled yarn sections. After the yarn has passed underneath the photosensor, it is lifted by rolls not shown in FIGS. 1 and 3 off the support onto which it had been deposited without tension, and transported away. The gas stream passed through the yarn and the moving support is preferably limited to the region where the yarn is in contact with the support surface and the optical sensor. This has the advantage that, after the measurement, the yarn is easily removable again from the support. A particularly advantageous embodiment of the moving gas permeable support (1) on which the tension-free yarn is moved past the optical sensor during the measurement is essentially gas impermeable and has only a narrow zone (9) of gas permeability extending in the transport direction (arrow (6)). This embodiment has the substantial advantage that the yarn, which is delivered by the delivery system only to within the vicinity of the narrow gas permeable zone, becomes automatically centered on this zone and laid down flat. This ensures automatic centering in relation to the photosensor, which leads to particularly reliable measurements.

To obtain a particularly strong useful signal from the photosensor, the yarn can be deposited for measurement onto a yarn transport support which has contrasting coloring to the color of the yarn.

It has been found that the strength of the signal can be additionally improved to a considerable extent by depositing the yarn for measurement onto a yarn transport support having very different reflectance properties from the yarn. This is because if the deposited yarn and the yearn transport support have contrasting colorings, they have different reflectance spectra, but the total amount of reflected light preferably will be of similar magnitude. To obtain a sufficiently strong useful signal, it is therefore necessary to adapt the reflectance spectra and the spectral light sensitivity of the photosensor to one another in such a way that a very strong useful signal is obtained in one of the reflectance spectra, for example that of the yarn, while a very weak useful signal is obtained in the other reflectance spectrum, for example that of the support. This adaptation can present difficulties and, in certain circumstances, presuppose the interposition of color filters which cause additional light attenuation and hence a reduction in the useful signal. If, by contrast, the reflectance properties of the yarn and the yarn transport support are made different, this means that the quantities of light reflected by yarn and yarn transport support differ and that possibly, although not necessarily, there may in addition be spectral differences in the reflected light. In this way it is possible to obtain high useful levels for the signal emitted by the photosensor independently of the spectral sensitivity of the photosensor and without the interposition of filters and without adaptation of the spectral light sensitivity of the sensor material, i.e. without restriction in the choice of sensor.

The reflectance properties of yarn and yarn transport support may differ because the yarn and the yarn transport support reflect the light diffusely, i.e. more or less uniformly in all directions, but to very different extents. FIG. 7 is a schematic illustration of this principle. It shows, in section, the yarn (3) deposited on a gas permeable region (9) of the yarn transport support (1). The incident light symbolized by the rays (28) is reflected approximately uniformly in all directions not only by the yarn transport support but also by the yarn, but the amount of light (29) reflected by the yarn and the amount of light (30) reflected by the yarn transport support differ, which is signified by the length of the arrows (29) and (30) symbolizing the reflected light.

Since the yarn in general is a diffuse reflector of a high proportion of the incident light, the reflectance of the yarn transport support is advantageously very low.

This principle can be put into effect by reducing the reflectance of the yarn transport support as much as possible by application of black, matt colors, by burnishing, by eloxation and, if required, by additional roughening of the surface, for example by sand blasting.

In practice it is found that none the less all the surfaces still give a certain weak but none the less disadvantageous reflectance. It is further found in practice that the reflectance of the yarn transport supports surface-treated in this manner can differ locally.

It is then found that along the length of such a yarn transport surface the background reflectance fluctuates by an admittedly small but certainly disadvantageous amount—due to mechanical manufacturing tolerances, density differences on surface application, inhomogeneous surface roughnesses and the like. In relation to signal detection, this disadvantageously constrains the tolerances for setting threshold values and trigger levels. In certain circumstances, it is even necessary to employ "floating" limits - only possible with an expensive control system - to make a high sensitivity level meaningful again.

A considerably farther reaching improvement is attainable, then, by making the reflectance of yarn and yarn transport support very different by (a) providing the support with a surface which gives off virtually no diffusely reflected light but which reflects bundled incident light very strongly in bundle form in a preferential direction and (b) using a light source which projects a bundled light beam at the measuring position at such an angle $\alpha$ that the light reflected by the support in substantially bundled form cannot impinge on the photosensor. The yarn itself of course retains its diffuse reflection characteristics.

This principle can be realized in various ways.

One possibility is to provide the yarn transport support with a surface which reflects incident light in accordance with the law of reflection; that is, the surface of the yarn transport support is mirror coated. The reflection of incident light by the law of reflection is such that a light beam incident upon the yarn transport support at an angle $\alpha$ relative to the normal is reflected by the surface at an angle $-\alpha$, measured from the normal. If therefore the yarn deposited on such a mirror coated yarn transport support is illuminated at an angle $\alpha$ and the photosensor is mounted above the yarn in the direction of the normal, the photosensor no longer receives any light reflected by the yarn transport support, but only receives light reflected by the diffusely reflecting yarn. This arrangement gives a dramatic increase in the strength of the useful signal. FIG. 8 illustrates this principle of measurement. It shows, in section, schematically the yarn (3) deposited on the gas permeable zone (9) of the yarn transport support (1), the light incident at an angle $\alpha$ relative to the normal (31) which is symbolized by the rays (28), the light reflected by the yarn transport support an angle $-\alpha$ relative to the normal (31) which is symbolized by the rays (30), and the light diffusely reflected by the yarn which is symbolized by the rays (29). It can be seen that the photosensor (8) is only impinged upon by the light diffusely reflected by the yarn. A certain technical difficulty with the realization of this principle of measurement is that the yarn transport support must consist of a material which is satisfactorily mirror coatable. Similarly, the production of a satisfactorily functioning mirror requires a substantially smooth surface structure on the yarn transport support. Although these requirements are technically manageable, they are inconvenient.

Figure 9:
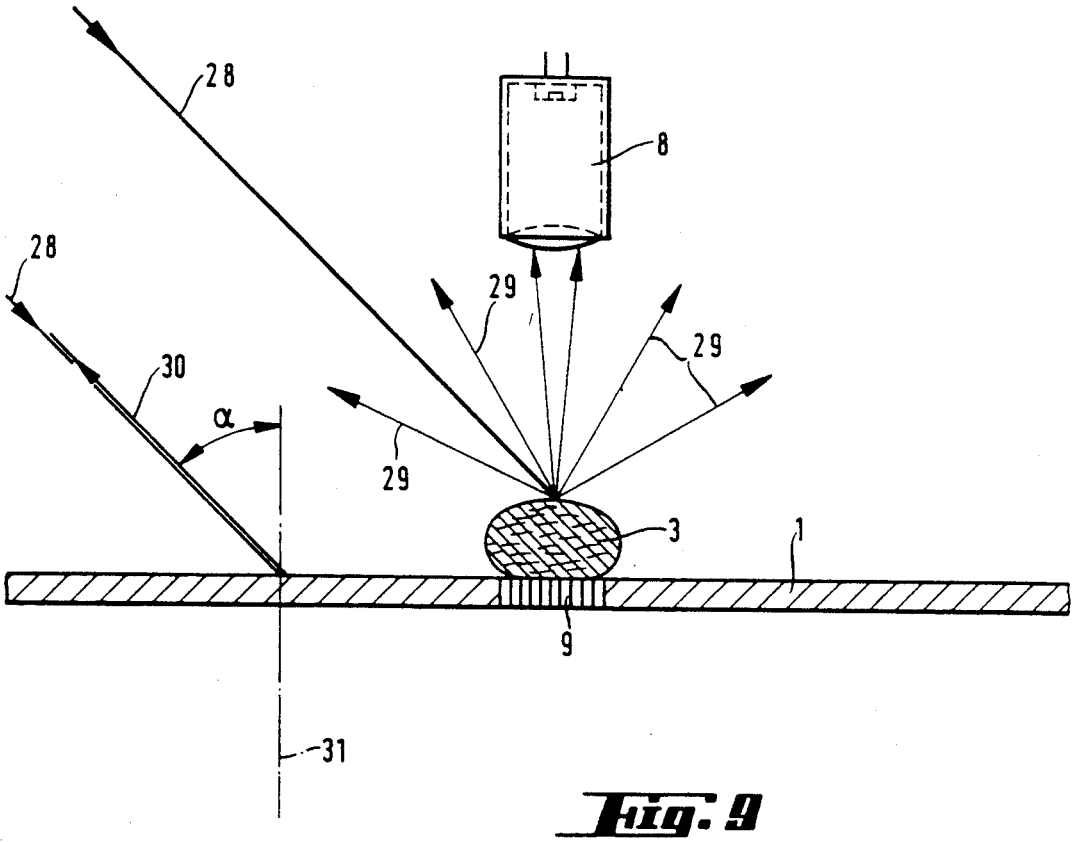

A further substantial improvement in this measuring method results on providing the surface of the yarn transport support with a covering which always reflects incident light, irrespectively of its angle of incidence, back into the light source. FIG. 9 shows this embodiment of the measuring method according to the invention. It schematically shows in section the yarn (3) deposited on a permeable region (9) of the yarn transport support (1). The rays (28) symbolize the incident light and the rays (29) and (30) the reflected light. It can be seen that the light beam (28) incident upon the yarn transport support at an angle $\alpha$ relative to the normal (31) is reflected back at the same angle $\alpha$, whereas the light beam (28) which is incident upon the yarn is reflected diffusely in all directions. Here too the photosensor (8) is exclusively impinged upon by the light rays diffusely reflected by the yarn.

Surfaces which always reflect incident light back into the light source are already known, and it is therefore easily possible to provide the yarn transport support with such a surface. The simplest thing in practice is to equip the yarn transport support with a foil which has the desired reflection characteristics. Such a foil, which is also used for example in the modern coating of traffic signs or even license plates, basically has the following structure: A base material which in the uncured state is plasticizable, hardenable or stabilizable, for example a base material made of silicone rubber, is vacuum vapor deposition coated or alternatively electroplated with a metal layer of high reflectance. A glass bead filled plastics material, for example a mixture of glass beads having an average diameter within the range from 65 to 130 $\mu$m and a polycarbonate, is applied to this base material and pressed in under mechanical pressure. The pressing of the glass beads into the metallically vacuum vapor deposition coated or electroplated backing creates a large number of spherical cavities in the backing in accordance with the geometry of the beads. The base material is then stabilized by suitable measures. The metallically vacuum vapor deposition coated background is accordingly basically a mirror with a systematically embossed surface. A foil thus manufactured has the property of always largely reflecting incident light back into the light source irrespectively of the angle of incidence of the light. Foils of this type are commercially available.

Figure 4:
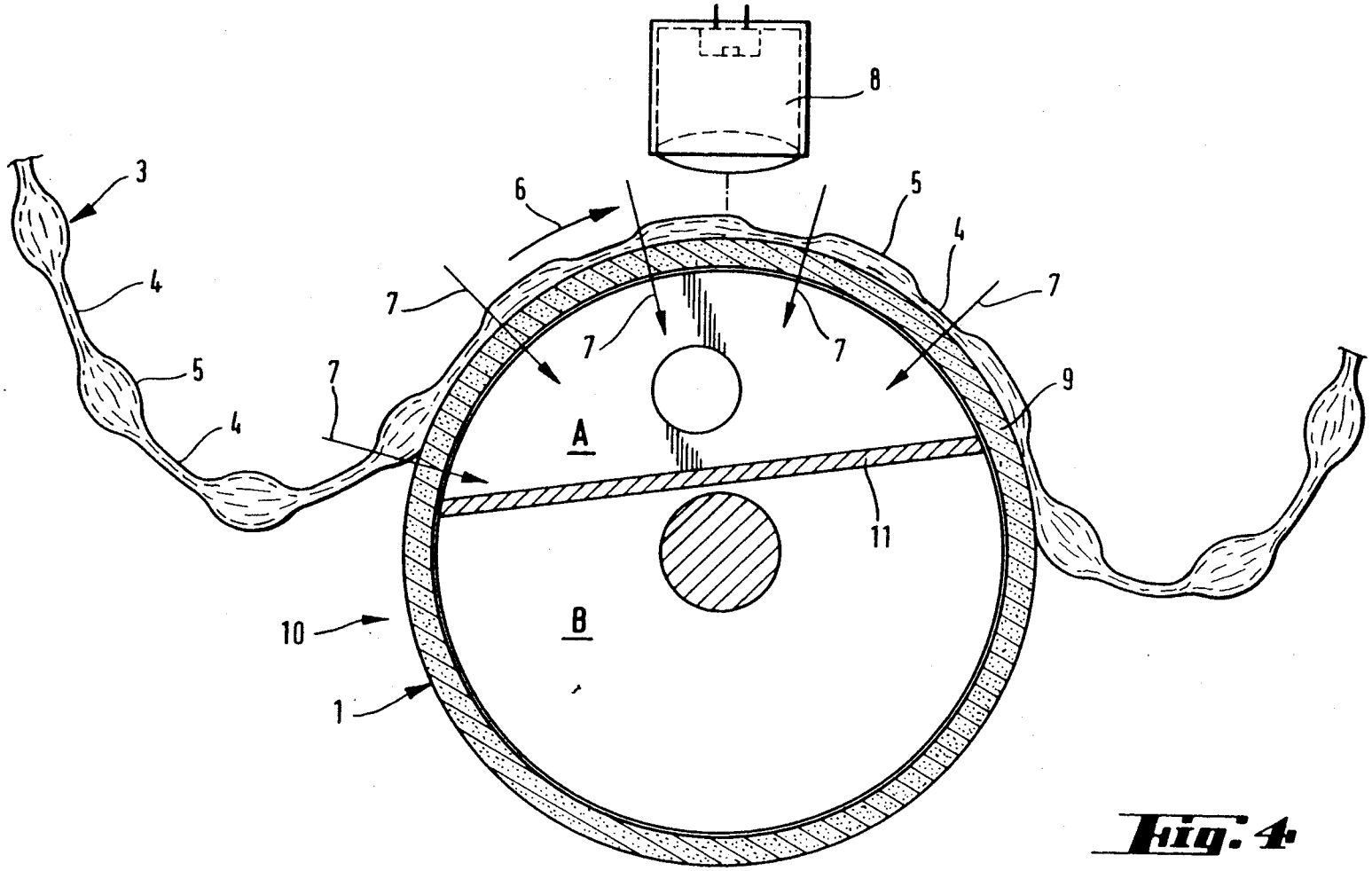
FIG. 4 shows an at least partly gas permeable yarn deposition surface (1) in the form of a hollow roll (10) supporting a deposited yarn (3) with intermingled (4) and non-intermingled (5) yarn sections, the optical sensor (8) and the stationary separating wall (11) which partitions the interior of the hollow roll (10) into the sections A and B. The arrow (6) indicates the direction of rotation of the hollow roll, and the arrows (7) indicate the direction of the gas stream flowing through the yarn and the gas permeable regions of the hollow roll.

A further very convenient refinement of the measuring method according to the invention provides that the yarn is deposited on the at least partly gas permeable shell of a hollow roll which rotates about its longitudinal axis, a gas flowing through the shell from outside to inside. FIG. 4 schematically shows an arrangement which is suitable for this embodiment of the method according to the invention. It can be seen that the yarn (3) is transported tensionlessly up to the hollow roll rotating in the arrow direction (6) and once there is forced by the gas stream flowing in the direction of arrows (7) through the porous shell (1) of the hollow roll flat against the shell of the roll. In this form, the yarn is transported by the rotating roll passed underneath the photosensor (8). Downstream of the photosensor the yarn is then again lifted loosely off the hollow transport roll. Here too it is possible to provide a special means for facilitating removal of the yarn off the hollow roll by providing on the inside of the hollow roll a separating wall (11) which partitions the interior of the hollow roll in the two compartments A and B, of which only compartment A is under reduced pressure. In this way, the gas stream forcing the yarn against the shell is limited to where the yarn has been deposited and to the region of the photosensor. The yarn removal, by contrast, is not impaired.

A further, very advantageous refinement of the method according to the invention provides that the signals emitted by the photosensor are processed and registered by a connected arithmetic processing unit. It is particularly advantageous for the signals from the photosensor first to be sent to an electronic classifier which classifies the yarn irregularities by size and sends the classified signals separately by class to the arithmetic processing unit. The electronic classifier can work in a conventional manner, for example in that the signals from the photosensor which have been amplified by an analog amplifier are first sent to a gate of the Schmitt trigger type with faculatatively adjustable trigger voltages. A further advantageous embodiment of the method according to the invention and the apparatus according to the invention is obtained on using the above-described self centering of the yarn (for example over a row of holes) and a double light guide where one of the light guides projects a light spot and a second light guide measures the light reflected by said spot.

In this case, the diameter of the projected light spot can be made smaller than the diameter of the non-intermingled yarn places and positioned outside the central axis of the yarn, so that it only impinges upon the bulges of the yarn and, if above an intermingled area, impinges 100% on the surface (and not the yarn).

The effect of this arrangement is that from the start it emits only at the yarn bulges a positive signal which acts as a quasi trigger signal. The intervals between successive descending flanks of the trigger signal can be measured in multiples of a freely selectable unit time and the result can be used for classifying the yarn faults. It is of course also possible to use other known classifying options for the method according to the invention and realize them in the form of appropriate circuitry.

The present invention further provides a measuring apparatus for carrying out the measuring method according to the invention. Such a measuring apparatus has a moving, at least partly gas permeable support on which the yarn to be measured is deposited and transported with low or no tension, a gas pressure gradient between the two sides of the support, which generates a gas stream through the support directed from the yarn deposition side to the back of the support, deposition and removal means which effect a low-tension or tensionless deposition of the yarn and its removal and its continued transport, and a stationary optical sensor which in relation to the moving yarn transport support is positioned in such a way that it can detect the yarn geometry and that intermingled and non-intermingled yarn sections lead to different signals. A schematic representation of the essential developments of such a measuring means according to the invention is shown in the above-described FIG. 1.

In a particularly advantageous embodiment, the measuring apparatus according to the invention includes a yarn transport support possessing only a narrow gas permeable zone extending in the transport direction of the support. The gas permeability of the yarn transport support can be the result of the support or the gas permeable zone of the support having small bores through which the gas can flow in accordance with the pressure gradient. Other possibilities are to form the gas permeable support or zone from a porous material, for example a sintered glass or ceramic material or an open-pored foam. An open-pored organic foam can if necessary be provided by combination with a mechanically stable grade of metal or plastics wires or an equivalent stabilization. The gas permeable support or zone can of course also be realized in the form of a finely meshed sieve.

Advantageously, the apparatus according to the invention is provided with a device which adapts the speeds of the yarn transport support and the delivery speed of the yarn to one another to such an extent that the yarn comes to be laid virtually tension-free on the support. Such a control system can be for example realized by making the yarn form a small freely suspended loop between the delivery system and the deposition point onto the yarn transport support, the size of the loop controlling the speed of the transport support and/or of the yarn delivery system. Basically, any control means which controls the transport speed and/or the delivery speed as a function of the length of the yarn delivered per unit time is suitable for this purpose.

A further preferred embodiment of the measuring apparatus according to the invention provides that the yarn transport support is the at least partly gas permeable shell of a hollow roll which on the inside and preferably locally has a lower gas pressure than on the outside. It is particularly preferable for the shell of said hollow roll not to be gas permeable as a whole but to have a gas permeable zone which encircles the roll on a perpendicular section line. Such an embodiment has the advantage that the yarn deposited thereon becomes automatically centered on the gas permeable zone and hence always remains in the same favorable position relative to the photosensor even in the course of prolonged high-speed yarn transport.

A preferred measuring apparatus improved within the meaning of the observations about the measuring method provides that the support for the yarn to be measured has reflection characteristics different from the yarn.

One way of realizing this feature is to equip the support by one of the above-indicated measures, for example blacking or burnishing with or without additional roughening, with a surface which is a diffuse and very weak reflector. A further dramatic improvement of the useful signal from the photosensor is obtainable by using a measuring apparatus (a) whose yarn transport support has a surface which reflects bundled incident light very strongly in a preferential direction in bundled form and
(b) which has a light source which projects a bundled light beam at the measuring position at such an angle $\alpha$ that the light reflected by the support does not impinge on the photosensor.

A possible way of realizing this preferred principle is for the yarn transport support of the measuring apparatus to have a planarized and mirror coated surface, so that it reflects incident light in accordance with the law of reflection.

A particularly preferred embodiment of the measuring apparatus according to the invention provides that the surface of the yarn transport support reflects incident light back into the light source.

This is advantageously achieved by providing the surface foil described above and as marketed for example by the company Scotch.

A further, preferred embodiment of the method according to the invention, where the measurements are processed with a connected arithmetic processing unit, gives rise to further appreciable advantages: for example a freely adjustable zero point for the reproducible setting of count-related pressure lines, the choice of the yarn test length, the classification of faults and counting of classified faults per unit yarn length, and production of a fault histogram. The evaluation of the number of intermingling points thus determined and, if of interest, their size and distribution as well is effected by means of conventional arithmetic algorithms; the further processing of the measurements is then adapted to the particular problem situation.

Particular preference is given to those embodiments of the measuring method according to the invention and the measuring apparatus according to the invention where a plurality of preferred features are present.

The method according to the invention and the robust measuring apparatus according to the invention are highly suitable for the continuous monitoring of the degree of intermingling of production material in the laboratory.

Since the method according to the invention can be operated at yarn transport speeds which correspond to the high transport speeds of texturing machines, it is even possible to carry out on-line control of the degree of intermingling, so that even immediate, preferably automatic, management of yarn production process parameters can be effected.

Figures 6A, 6B:
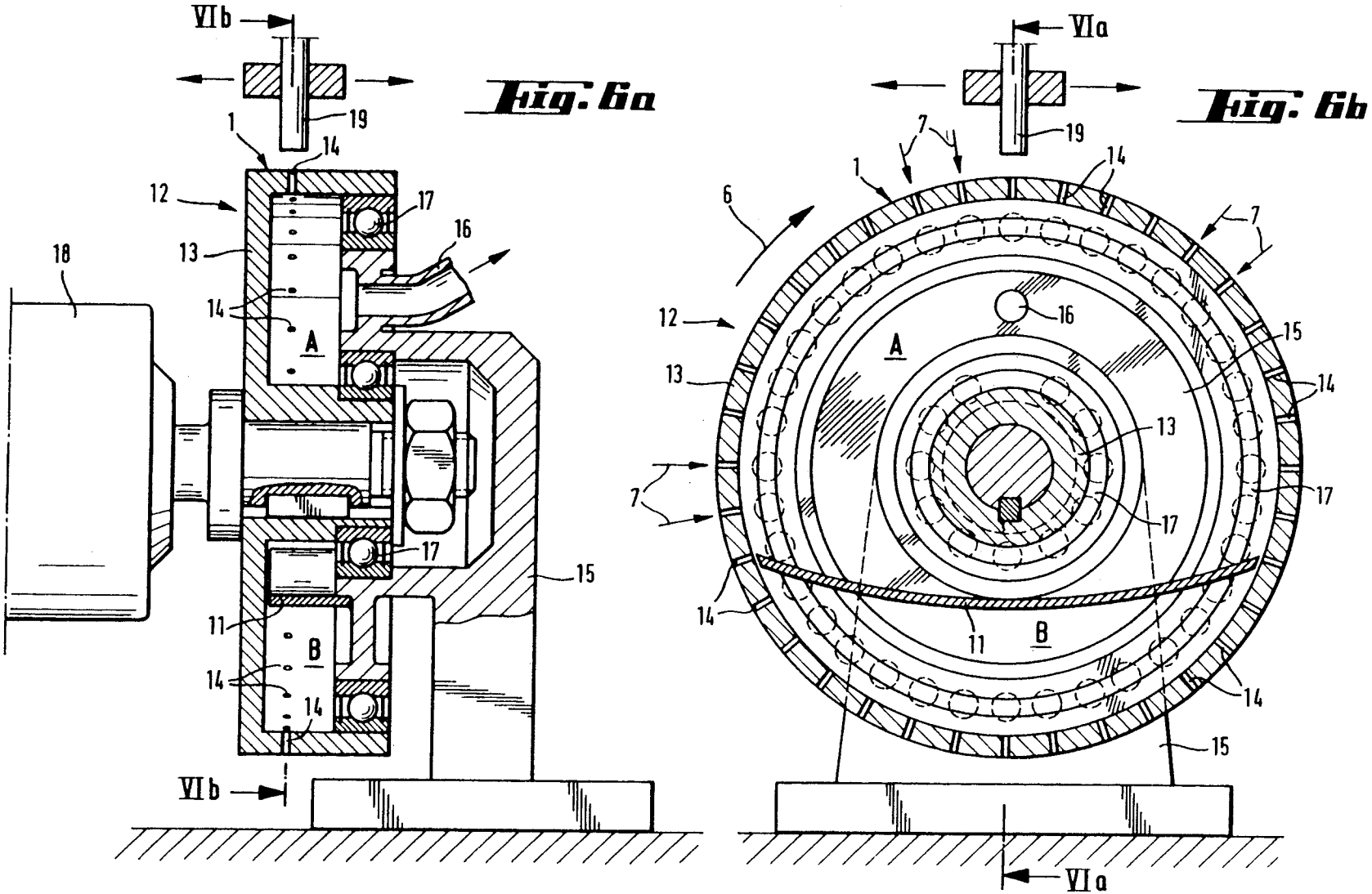
FIG. 6*a* shows a section in the plane VIa—VIa of FIG. 6*b* and FIG. 6*b* a section in the plane VIb—VIb of FIG. 6*a* through an illustrative, preferred embodiment of the novel apparatus for carrying out the novel measuring method, comprising a yarn guide and transport roll (12) consisting of a hollow roll rotor (13) whose shell surface forms moving, at least partly gas permeable support for the deposition of a yarn and in which the bores (14) have been introduced at regular intervals from one another, the staple (15) with the opening for the air intake pipe (16), fitted via ball bearings (17) into the open side of the hollow roll (13), a separating wall (11) which is attached to the staple and which partitions the interior of the hollow roll into the compartments A and B, the drive motor (18) for the rotor (13), and the optical sensor (19) in the form of a freely adjustable light guide system comprising a light feeder guide and a reflected light return guide.

The example which follows shows an embodiment of the apparatus according to the invention, its function and the implementation of the measuring method according to the invention using this apparatus. The advantageous embodiment of the method according to the invention described here by way of example utilizes an apparatus according to FIGS. 6*a* and 6*b* which includes a yarn deposition and transport means in the form of a hollow roll. The apparatus consists of two mutually inserted halves, of which one half, the rotor (13), can be set in rotation by means of a drive motor (18) while the other half, the stator (15), remains stationary. Ball bearings (17) ensure the positive connection between these two halves.

The rotor, which has the form of a hollow roll, has been provided on its shell with a row of holes (14) approximately 1 mm in diameter exactly in a plane perpendicular to the axis of rotation. The opening (16) of the stator has been put under reduced pressure via an appropriate connection pipe.

A separating wall (11) likewise attached to the stator and facing the inside of the hollow roll confines the reduced pressure on the inside of the hollow roll to the upper compartment A. This separating wall has on the rotor side a drag lip which provides a substantially airtight seal.

The shell surface of the rotor has a dark or matt black color to avoid light reflection or, in a preferred embodiment, is covered with a light reflection foil which reflects incident light back into the light source.

Figure 5:
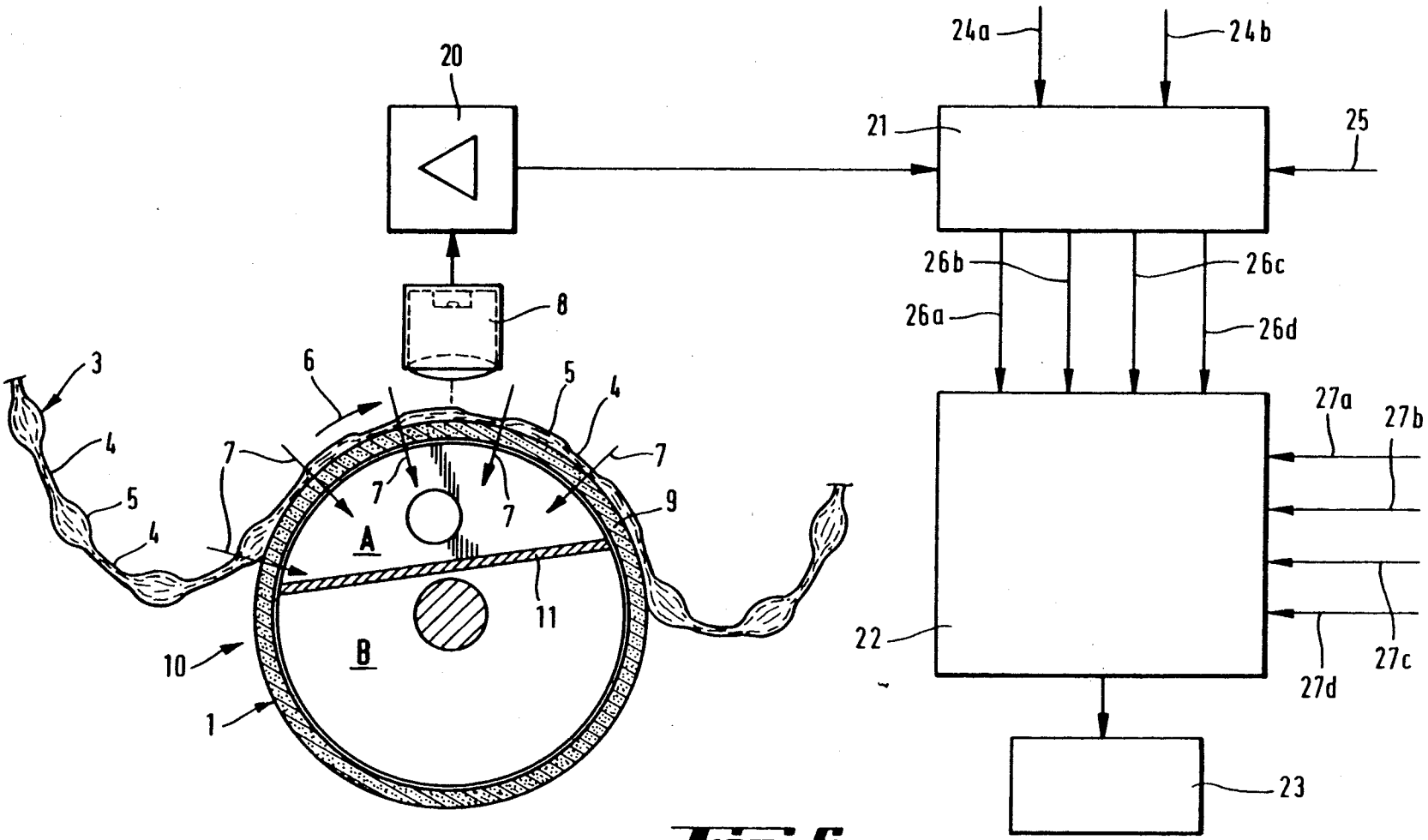
FIG. 5 shows schematically a preferred embodiment of the measuring apparatus for carrying out the measuring method according to the invention, featuring the intermingled yarn (3) with intermingled (4) and non-intermingled (5) yarn sections which becomes deposited on the hollow roll (10) turning in the direction (6), the photosensor (8), the signal from which is amplified in the analog amplifier (10) and transmitted to the electronic evaluator (21), the arithmetic processing unit (22), which receives the signals emitted by the electronic evaluator (21) and processes them, and the printer (23), which prints out the measurements in a clearly laid-out form. The signal lines 24*a* and 24*b* supply the electronic evaluator with the trigger levels 1 and 2 at which the analog signal sets or resets the Schmitt trigger. Incoming line 25 supplies a digital time signal, and outgoing lines 26*a, b, c* and *d* supply outward signals representing the detected intermingling faults. The incoming lines (27*a, b, c* and *d*) supply the arithmetic processing unit (22) with signals representing the test length interval, the discriminator level, the yarn speed and other general experimental data.

The apparatus described here is coupled as per FIG. 5 via the analog amplifier (32) and the electronic evaluator (33) to the arithmetic processing unit (34).

If the functioning, i.e. rotating and depressurized, perforated hollow roll is supplied with a yarn from a delivery system, the yarn becomes fixed and centered on the row of holes in the rotating hollow roll owing to the air sucked from the outside through the holes onto the inside of the hollow roll. In the apparatus described, it is sufficient if the yarn is brought to a distance of about 100 mm from the hollow roll; it is then extracted and as it were automatically fixed and accurately centered.

This system offers a further advantage. Owing to the suction effect, the otherwise rather rotation-symmetrical non-intermingled areas flatten out against the rotor surface, temporarily assuming a plainer and spread-out state. The diameter of the non-intermingled areas even become somewhat larger as a result, in the same way as if the yarn was laid onto a flat metal surface and then pressed firmly against this metal surface by means of a glass plate. The yarn becomes fixed on the rotating hollow roll in the region of the reduced pressure chamber A and, on leaving this region owing to its continued transport by the hollow roll, is released again. Downstream of this point the yarn can be taken up again and guided to its further use.

As the yarn is transported on the yarn deposition and transport means past the photosensor (19), the latter emits an electrical signal (current or voltage) whose strength corresponds to the spreading out of the yarn. This signal is supplied to an analog amplifier and an electronic evaluator, for example a time digital converter (TDC). In a possible embodiment of this electronic evaluator, the analog signal switches a Schmitt trigger whose hysteresis is determined by the switching voltages (trigger levels) supplied via the lines (24*a*) and (24*b*). Through suitable choice of the hysteresis, the sensitivity of the apparatus becomes infinitely adaptable to the nature of the yarn to be tested. The switching-on times of the Schmitt trigger are measured by means of a supplied digital time signal in multiples of a choosable unit. In this way, the digital converter classifies the intermingling faults by summed time signals into single, double, triple or larger intermingling areas. A time cycle starts each time trigger level 1 is passed through and is stopped when trigger level 2 is passed through. The ultimately desired intermingling fault histogram is produced by the arithmetic processing unit (22) and printed out by the printer (23).

We claim:

1. A method for measuring the degree of intermingling of yarns where an optical sensor is used to register intermingling and non-intermingled yarn sections, which comprises performing a measurement of yarn properties on a yarn which has been laid with no or minimal tension onto a moving support which transports the yarn past an optical sensor at a predetermined, constant speed and at a distance for measuring the yarn properties.

2. The method as claimed in claim 1, wherein the minimal-tension or tension-free deposition takes place onto a moving, at least partially gas permeable yarn support having a yarn deposition side through which a gas stream is passed.

3. The method as claimed in claim 1, wherein the yarn is laid for measurement onto a yarn transport support which has a contrasting coloring to the color of the yarn.

4. The method as claimed in claim 3, wherein the yarn is laid for measurement onto a yarn transport support whose surface reflects incident light.

5. The method as claimed in claim 2, wherein the yarn is deposited onto a transport support which has only a narrow zone of gas permeability extending in the transport direction of the support and the yarn is deposited onto this narrow gas permeable zone.

6. The method as claimed in claim 2, wherein the yarn is deposited onto the at least partly permeable shell of a hollow roll rotating about its longitudinal axis while a gas flows through the shell from outside to inside.

7. The process as claimed in claim 1, wherein the measurement of yarn properties is carried out on a yarn which is transported on its support at a delivery speed of the yarn onto the support.

8. The method as claimed in claim 1, wherein the intermingled and non-intermingled yarn sections are detected photoelectrically and the photoelectric signals are processed and registered by a connected arithmetic processing unit.

9. The method as claimed in claim 1, wherein the yarn is laid for measurement onto a yarn transport support which has reflection characteristics different from the yarn.

10. The method as claimed in claim 9, wherein the yarn is laid for measurement onto a yarn transport whose surface reflects incident light.

11. A measuring apparatus for measuring the degree of intermingling of yarns where an optical sensor is used to register intermingled and non-intermingled yarn sections comprising a moving, at least partly gas permeable support for the yarn to be measured, the support having two sides including a yarn deposition and a back side, a gas pressure gradient between the two side of the support which creates a gas stream directed from the yarn deposition side through the back thereof, deposition and removal means which effect a low tension or no-tension deposition of the yarn and the removal and the continued transport of the yarn, and an optical sensor for detecting the intermingled and non-intermingled yarn sections.

12. The measuring apparatus as claimed in claim 11, wherein the yarn deposition and transport support has only a narrow zone of gas permeability extending in the transport direction of the support.

13. The measuring apparatus as claimed in claim 11, which includes a control means which adapts the speed of the yarn deposition and transport means and the yarn delivery speed to one another in such a way that the yarn is deposited on the support relatively without tension.

14. The measuring apparatus as claimed in claim 11, wherein the yarn deposition and transport means is the at least partly gas permeable shell of a hollow roll which on the inside has locally a lower gas pressure than on the outside.

15. The measuring apparatus as claimed in claim 14, wherein the hollow roll has an encircling gas permeable zone lying on a section line perpendicular to the axis of rotation.

16. The measuring apparatus as claimed in claim 14, wherein the at least partly gas permeable shell of the hollow roll reflects incident light back into the light source.

* * * * *

UNITED STATES PATENT AND TRADEMARK OFFICE

CERTIFICATE OF CORRECTION

PATENT NO. : 4,990,793

DATED : FEBRUARY 5, 1991

INVENTOR(S) : BURKHARD BONIGK ET AL

It is certified that error appears in the above-identified patent and that said Letters Patent is hereby corrected as shown below:

Column 9, line 4, after "surface" insert -- with a light reflection --.

Column 10: Claim 2, line 62, after "yarn" insert -- transport --.

Column 11: Claim 6, line 12, before "permeable" insert -- gas --.

Column 10, line 62, "Partially" should read--Partly--.

Signed and Sealed this

Twenty-first Day of July, 1992

*Attest:*

*Attesting Officer*

DOUGLAS B. COMER

*Acting Commissioner of Patents and Trademarks*